US009141048B2

(12) United States Patent
Satoh et al.

(10) Patent No.: US 9,141,048 B2
(45) Date of Patent: Sep. 22, 2015

(54) FIXING DEVICE AND IMAGE FORMING APPARATUS

(71) Applicants: Tsukasa Satoh, Kanagawa (JP); Hironori Yamaoka, Kanagawa (JP); Shinichi Namekata, Kanagawa (JP)

(72) Inventors: Tsukasa Satoh, Kanagawa (JP); Hironori Yamaoka, Kanagawa (JP); Shinichi Namekata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/206,301

(22) Filed: Mar. 12, 2014

(65) Prior Publication Data

US 2014/0270824 A1 Sep. 18, 2014

(30) Foreign Application Priority Data

Mar. 14, 2013 (JP) ..... 2013-052089

(51) Int. Cl.
*G03G 15/20* (2006.01)

(52) U.S. Cl.
CPC ..... *G03G 15/2042* (2013.01)

(58) Field of Classification Search
USPC ..... 399/341
See application file for complete search history.

(56) References Cited

U.S. PATENT DOCUMENTS

| | | | | |
|---|---|---|---|---|
| 5,991,565 | A * | 11/1999 | Hanyu et al. | 399/69 |
| 7,248,807 | B2 | 7/2007 | Oka et al. | |
| 7,546,049 | B2 | 6/2009 | Ehara et al. | |
| 8,073,352 | B2 | 12/2011 | Kunii et al. | |
| 2011/0091225 | A1 * | 4/2011 | Yamamoto | 399/33 |
| 2013/0209115 | A1 | 8/2013 | Hase et al. | |
| 2013/0209120 | A1 | 8/2013 | Namekata et al. | |
| 2013/0209121 | A1 | 8/2013 | Uchitani et al. | |
| 2013/0209124 | A1 | 8/2013 | Saito et al. | |
| 2013/0209128 | A1 | 8/2013 | Saito et al. | |
| 2013/0209131 | A1 | 8/2013 | Uchitani et al. | |

FOREIGN PATENT DOCUMENTS

| | | |
|---|---|---|
| JP | 57-053773 | 3/1982 |
| JP | 63-044223 | 2/1988 |
| JP | 2003-186344 | 7/2003 |
| JP | 2003-272802 | 9/2003 |
| JP | 2006-208419 | 8/2006 |
| JP | 2006-208509 | 8/2006 |
| JP | 2006-292850 | 10/2006 |
| JP | 2009-175679 | 8/2009 |
| JP | 4687043 | 5/2011 |

(Continued)

*Primary Examiner* — Clayton E Laballe
*Assistant Examiner* — Jas Sanghera
(74) *Attorney, Agent, or Firm* — Harness, Dickey & Pierce

(57) ABSTRACT

A fixing device, corresponding to a plurality of sheet passing widths, includes a rotating member configured to convey a recording medium, rise in temperature, and fix toner; temperature sensors configured to detect the surface temperature of the rotating member; heating members including at least one heat generating unit, provided inside the rotating member; and a control unit configured to control a heating state obtained by the heating members. The heat generating units are provided not to overlap each other in the direction of the sheet passing width orthogonal to the recording medium conveying direction. The temperature sensors are only placed at positions corresponding to the heat generating units used when printing on the recording medium having a minimum width. The control unit controls the heating state in accordance with the surface temperature, a sheet passing width, and an operational state of the rotating member that changes with time.

12 Claims, 6 Drawing Sheets

(56) References Cited

FOREIGN PATENT DOCUMENTS

| | | |
|---|---|---|
| JP | 2013-164439 | 8/2013 |
| JP | 2013-164446 | 8/2013 |
| JP | 2013-164451 | 8/2013 |
| JP | 2013-164474 | 8/2013 |
| JP | 2013-178486 | 9/2013 |
| JP | 2013-178487 | 9/2013 |
| JP | 2013-178488 | 9/2013 |

* cited by examiner

FIXING DEVICE AND IMAGE FORMING APPARATUS

BACKGROUND OF THE INVENTION

1. Field of the Invention

The present invention relates to a fixing device for fixing a toner image onto a recording medium such as a recording sheet, and an image forming apparatus including the fixing device.

2. Description of the Related Art

An image forming apparatus for forming images on a recording sheet by an electrophotographic method, as a copier, a fax machine, and a printer, charges a photoreceptor with a charging device, and then forms an electrostatic latent image on the surface of the photoreceptor by optical writing according to an original image or image information. This electrostatic latent image is turned into a toner image that is a visible image, by using toner of a developing device. This toner image is fixed onto a recording sheet as a fixing device applies heat and pressure onto the recording sheet, thereby obtaining a copy or a printout.

Presently, there are two methods used as a fixing device used in image forming apparatuses. One method is a roller method including a heating roller with a heat generating unit provided inside and a pressurizing roller that rotates by contacting the heating roller. A recording sheet is conveyed between the heating roller and the pressurizing roller, and heat and pressure is applied to the recording sheet to fix a toner image on the recording sheet. The other method is a belt method in which an endless fixing belt is wound around heating rollers provided with a heat generating unit. A recording sheet is conveyed between the fixing belt and a pressurizing roller, and heat and pressure is applied to the recording sheet to fix a toner image on the recording sheet. Furthermore, there are cases where the heat source is placed directly on the inside of the fixing belt.

Image forming apparatuses are desired to be highly productive and power-saving. Furthermore, image forming apparatuses are desired to have the capability of handling recording sheets of various thicknesses and sizes. Particularly, in a case of continuously passing through recording sheets made of cardboard while maintaining high productivity, the heat energy stored in the fixing device is consecutively taken away. Therefore, for the purpose of maintaining fixing properties, the heat generating source needs to be energized to apply heat so that the lost heat is replenished.

A fixing device using an infrared heater as the heat generating source is desired to quickly heat the heating roller by increasing the lighting rate of the infrared heater. Furthermore, in the case of a sheathed heater, the energizing rate needs to be increased. Here, the lighting rate and the energizing rate refer to the ratio of the power supply amount applying the actual heat generation amount, with respect to the power supply amount corresponding to the maximum heat generation capability.

In order to reduce the power consumption of a fixing device, unnecessary energization needs to be eliminated. In a case where a recording sheet having a narrow width is passed through the fixing device, for the purpose of eliminating any wasteful consumption of heat energy, the heat generating unit is divided in the sheet width direction, and the heating time of the heating roller is controlled in accordance with the width of the recording sheet (Patent Document 1).

Recently, there is used a fixing device in which the heating roller is made thin and the heat capacity of the heating roller is decreased, for the purpose of increasing the temperature rising rate. In recent years, there has been demand for high-speed printing operations, and therefore a large amount of heat of the heating roller is taken away by the sheets, which tends to cause an even larger temperature difference between the sheet passing part (part where the sheet passes) and the sheet non-passing part (part where the sheet does not pass). This is particularly significant in a fixing device in which the heating roller is made thin and the heat capacity of the heating roller is decreased for the purpose of increasing the temperature rising rate.

In order to compensate for the heat taken away by the sheets, the heater needs to be lit at a higher lighting rate. Accordingly, at the sheet non-passing part, the heat energy becomes excessively high and the temperature rises. In the worst case, the temperature exceeds the heatproof temperature of the heating roller (belt). Consequently, serious failures may occur, such as the deformation of a member.

In order to control the temperature rise due to heat, detailed temperature control operations are needed for each heat source, and therefore the surface temperature of the fixing device needs to be known in detail. Thus, when there are a plurality of heat sources, the number of temperature sensors increase according to the number of heat sources. However, an increase in the number of temperature sensors leads to an increase in cost. Thus, there is disclosed an example in which the temperature sensors are positioned such that the number of temperature sensors can be reduced (Patent Document 2).

Sheets are not always passed through the fixing device. Therefore, the contents of control operations of the heat sources differ between the time of warning up, i.e., when the power is first turned on and the temperature of the fixing device is raised, and the time of standby while waiting for the printing to start. There is disclosed an example of controlling the heat generation amount according to the state of the fixing device, because in the standby state while waiting for the printing to start, the necessary amount of heat generation decreases (Patent Document 3).

However, by the conventional method, power saving is not sufficiently implemented in the fixing device.

Patent Document 1: Japanese Examined Patent Application Publication No. S63-44223

Patent Document 2: Japanese Laid-Open Patent Publication No. 2003-272802

Patent Document 3: Japanese Patent No. 4687043

SUMMARY OF THE INVENTION

The present invention provides a fixing device and an image forming apparatus, in which one or more of the above-described disadvantages are eliminated.

According to an aspect of the present invention, there is provided a fixing device corresponding to a plurality of sheet passing widths in a direction orthogonal to a conveying direction of a sheet type recording medium, the fixing device including a rotating member configured to convey the sheet type recording medium, rise in temperature, and fix toner; a plurality of temperature sensors configured to detect a surface temperature on an outer side of the rotating member; a plurality of heating members having a line shape, each partially including at least one heat generating unit, the plurality of heating members being provided inside the rotating member in parallel with a rotation axis of the rotating member; and a control unit configured to control a heating state obtained by the plurality of heating members, wherein the heat generating units in the plurality of heating members are provided so as not to overlap with each other in the direction of the sheet passing width orthogonal to the conveying direction of the sheet type recording medium, the plurality of temperature sensors are placed at positions corresponding to the heat generating units used when printing on the sheet type recording medium having a minimum sheet passing width, and are not placed at positions corresponding to the heat generating units adjacent to the heat generating units used when printing on the sheet type recording medium having the minimum sheet passing width, and the control unit controls the heating state obtained by the plurality of heating members in accordance with the surface temperature, the sheet passing width, and an operational state of the rotating member that changes with time.

BRIEF DESCRIPTION OF THE DRAWINGS

Other objects, features and advantages of the present invention will become more apparent from the following detailed description when read in conjunction with the accompanying drawings, in which:

FIG. 2A illustrates a central joining method and FIG. 2B illustrates a side joining method;

FIG. 4A illustrates a central joining method and FIG. 4B illustrates a side joining method;

DETAILED DESCRIPTION OF THE PREFERRED EMBODIMENTS

Figure 1:
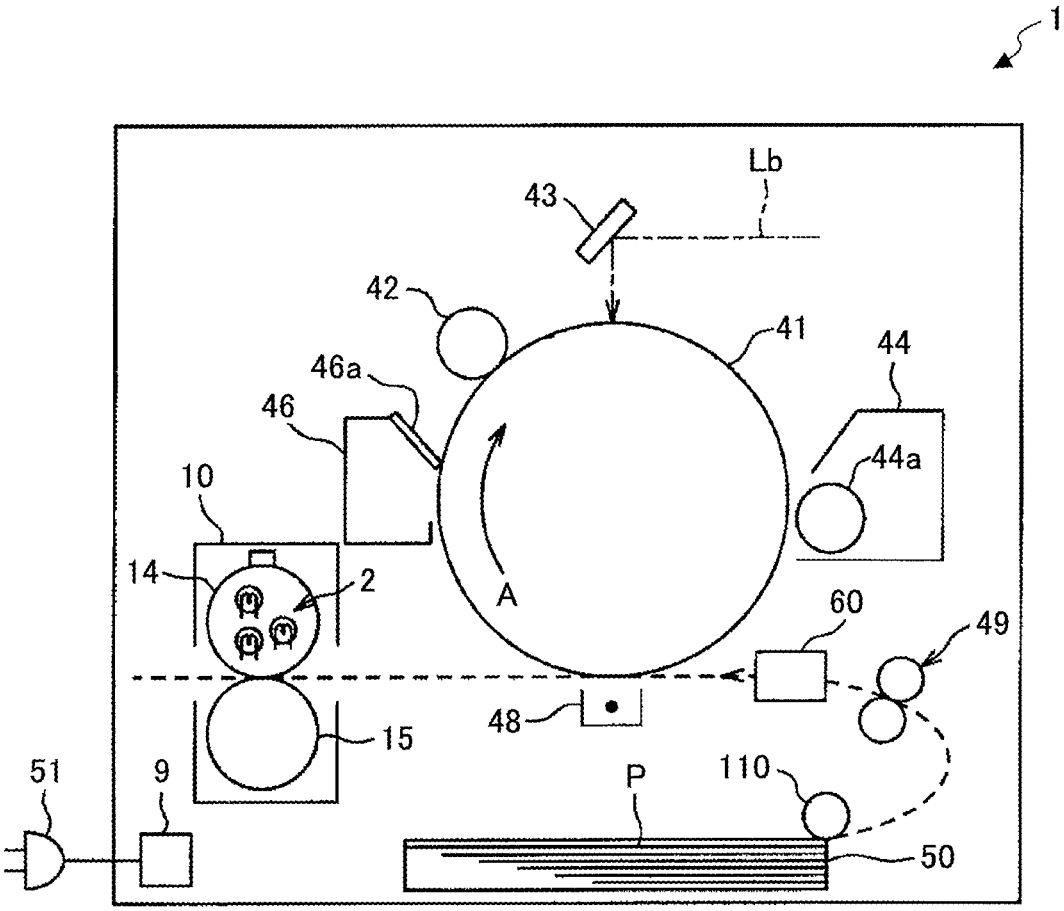
FIG. 1 is a schematic diagram illustrating the internal configuration of an image forming apparatus according to an embodiment of the present invention.

First, a description is given of an image forming apparatus 1 according to an embodiment of the present invention, with reference to FIG. 1. The image forming apparatus 1 according to the present embodiment is, for example, a copier, a fax machine, or a printer, and records images onto a sheet P that is a sheet type recording medium, by an electrophotographic method. The image forming apparatus 1 prints images onto recording sheets of various thicknesses and sizes, such as a plain paper sheet that is generally used for copying, an OHP sheet, and cardboard paper such as a postcard.

The image forming apparatus 1 includes a drum-type photoreceptor 41; and a charger 42, an exposing mirror 43 of an exposing device, a developing device 44, a transfer device 48, a fixing device 10, and a cleaning device 46, which are arranged around the photoreceptor 41 along a rotation direction A. Furthermore, a sheet feeding tray 50 storing sheets P is arranged at the bottom of the apparatus, and sheets are fed through a sheet quality checker 60 that is arranged according to need. Note that in the following description, the position where the charger 42 is arranged at the photoreceptor 41 is on the upstream where the rotation of the photoreceptor 41 starts, and the position where the cleaning device 46 is arranged at the photoreceptor 41 is on the downstream where the rotation of the photoreceptor 41 ends.

The charger 42 is constituted by a charging roller that contacts the surface of the photoreceptor 41, for uniformly charging the surface of the photoreceptor 41. The exposing device is provided on the downstream side of the charger 42. To the exposing mirror 43, a laser beam Lb is supplied, which is created by performing image processing on an image scanned by an image scanning device, and the supplied laser beam Lb is reflected onto the surface of the photoreceptor 41 to form an electrostatic latent image on the surface of the photoreceptor 41.

The developing device 44 is for visualizing the electrostatic latent image into a toner image by supplying toner onto the surface of the photoreceptor 41, and includes a developing roller 44*a* for supplying toner onto the surface of the photoreceptor 41. As the transfer device 48, a corona discharger is used, and the visualized toner image on the surface of the photoreceptor 41 is transferred onto the sheet P by corona discharging.

The fixing device 10 fixes the toner image by applying pressure and heat onto the sheet P. The cleaning device 46 is provided on the downstream side of the fixing device 10, and removes toner remaining on the surface of the photoreceptor 41 after transferring the toner image. In order to perform this removing, the cleaning device 46 includes a cleaning blade 46*a* that contacts the surface of the photoreceptor 41.

The sheet P that is a sheet type recording medium is stored in the sheet feeding tray 50 in a stacked state, and is extracted one by one by a sheet feeding roller 110. The extracted sheet P passes through a pair of registration rollers 49 and the sheet quality checker 60, and is conveyed between the photoreceptor 41 and the transfer device 48. By conveying the sheet P between the photoreceptor 41 and the transfer device 48, the toner image is transferred onto the sheet P. The sheet P onto which the toner image has been transferred is conveyed to the fixing device 10, and the toner image is fixed by the fixing device 10.

The sheet quality checker 60 examines the sheet thickness, the surface state, and the thermal property of the sheet P, and sends necessary information to the fixing device 10, etc. The sheet thickness can be examined by various sensors, by optically examining the intensity of transmitted light, and by mechanical contact. Furthermore, the sheet quality can be obtained by analyzing detection results of a reflected light. Furthermore, the thermal property can be known from temperature changes when the sheet P is passed through the heating roller, or from temperature changes obtained by measuring the temperature of the moving sheet P with time intervals after raising the temperature of the sheet P to a predetermined temperature with the heating roller.

Furthermore, the image forming apparatus 1 includes a main power supply device 9, and power is fed to the respective members described above by power from the main power supply device 9. To the main power supply device 9, power is supplied from a commercial power supply by inserting a plug 51 into an outlet.

The fixing device 10 according to the present embodiment used in the above image forming apparatus 1 is constituted by a heating roller 14 and a pressurizing roller 15 which are fixing members.

The sheet P is conveyed between the heating roller 14 and the pressurizing roller 15, and heat and pressure are applied onto the conveyed sheet P to fix the toner image on the sheet P. Inside the heating roller 14, heating units 2 which are heat generating elements are accommodated.

As the roller base of the heating roller 14, metal such as aluminum and steel is used, and therefore the heating roller 14 is prevented from deforming due to lack of endurance or heat. On the surface of the heating roller 14, a releasing layer is preferably formed, for preventing toner from adhering to the surface. Furthermore, inside the heating roller 14, a plurality of heating members are provided to heat the heating roller 14.

The pressurizing roller 15 has an elastic layer made of rubber, etc., provided on the outer periphery of the cored bar. When the pressurizing roller 15 contacts the heating roller 14, a nip part is formed between the pressurizing roller 15 and the heating roller 14. When a sheet P on which an unfixed toner image is formed is passed and conveyed through this nip part, the toner can be fixed to the sheet P by heat and pressure.

Note that a roller member having a foam layer may be used as the pressurizing roller 15 to form a nip part between the pressurizing roller 15 and the heating roller 14. In this case, because of the heat insulating effect of the foam layer, the heat of the heating roller 14 is not easily transferred to the pressurizing roller 15, and therefore the temperature of the heating roller 14 can be raised within a short period of time.

As the heating units 2, for example, a halogen heater or a sheathed line is used. The roller base of the heating roller 14 is preferably made of metal such as aluminum and steel, from the viewpoint of preventing deformation, etc., due to lack of endurance or pressure. Furthermore, on the surface of the heating roller 14, a releasing layer is preferably formed, for preventing toner from adhering to the surface. The inside of the heating roller 14 is preferably blackened, for the purpose of effectively absorbing the heat of the halogen heater. Here, as the heating roller 14, a fixing belt may also be included other than a heating roller.

Figure 2A:
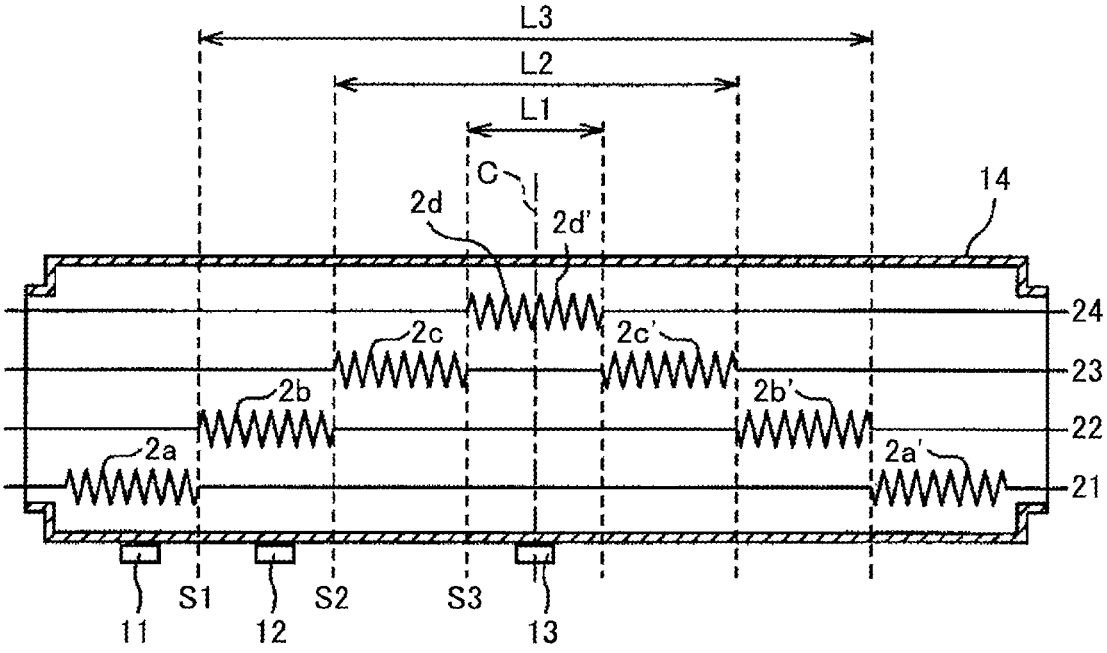
FIGS. 2A and 2B are schematic cross-sectional views illustrating positions of heat generating units of a fixing member according to an embodiment of the present invention, where
Figure 2B:
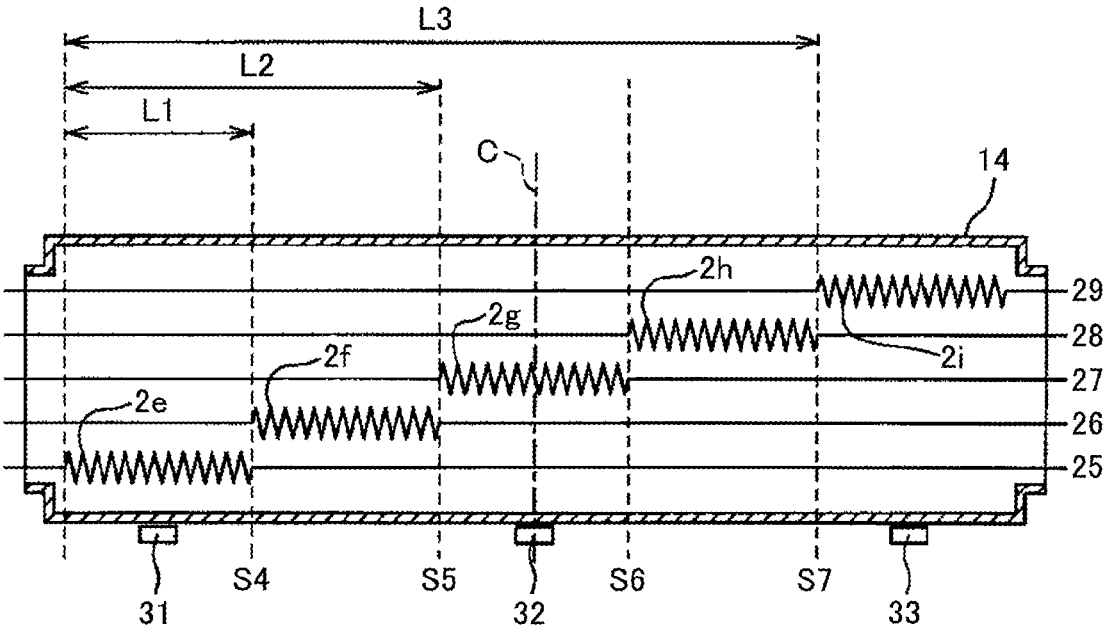

Next, with reference to FIG. 2A, a description is given of the internal structure of the heating roller 14 according to the present embodiment, in a case where the printing is performed at the center part of the fixing device 10. Furthermore, common descriptions are given for FIG. 2B which illustrates a case where the printing is performed at one side of the fixing device 10, and therefore reference numerals of FIG. 2B are indicated in parenthesis. Inside the heating roller 14, for example, a plurality of heating members 21 through 24 (25 through 29) are arranged as heating units. The heating members 21 through 24 (25 through 29) are provided inside the heating roller 14 in a state where the heating members are separately placed respectively in a direction orthogonal to the conveying direction of the sheet P, i.e., to be substantially parallel to the rotation axis of the heating roller 14 along the lengthwise direction of the heating roller 14. Furthermore, the heating members 21 through 24 (25 through 29) are provided at positions obtained by dividing the space of the heating roller 14 in a radial direction.

The heating operations of the heating members 21 through 24 (25 through 29) are controlled by a control unit provided in the image forming apparatus 1. In the present embodiment, halogen heaters that emit infrared rays are used as each of the heating members 21 through 24 (25 through 29), and the light emission of each halogen heater is controlled by the control unit. The control unit is for controlling the lighting rate of each of the halogen heaters.

Note that when a halogen heater is used as the heating members 21 through 24 (25 through 29), in order to efficiently absorb the heat of the halogen heater, the inside of the heating roller 14 is preferably blackened.

The heating members 21 through 24 (25 through 29) that are halogen heaters include light emitting units functioning as heat generating units. The light emitting units functioning as heat generating units are provided at positions obtained by dividing the direction orthogonal to the conveying direction of the sheet P, i.e., the sheet passing direction of the heating roller 14, into a plurality of positions, which are positions that do not overlap with positions of light emitting units of other heating members.

Next, a description is given of a configuration of light emitting units (heat generating units) and temperature sensors of a central joining method according to a first embodiment of the present invention, with reference to FIG. 2A. In FIG. 2A, the heating members 21 through 24 are arranged inside the heating roller 14. The main light emitting units of the heating members are placed at symmetrical positions with respect to a center line C. The light emitting units are divided such that a main light emitting unit 2*a* (2*a*') and a main light emitting unit 2*b* (2*b*') are divided at a boundary line S1 (S1'), a main light emitting unit 2*b* (2*b*') and a main light emitting unit 2*c* (2*c*') are divided at a boundary line S2 (S2'), and a main light emitting unit 2*c* (2*c*') and a main light emitting unit 2*d* (2*d*') are divided at a boundary line S3 (S3'), and the main light emitting units have light emitting areas at different positions so as not to overlap with each other in the sheet width direction.

Furthermore, on the surface of the heating roller 14, temperature sensors 11, 12, 13 for detecting the temperature on the roller are arranged. The temperature sensor 11 is provided at the main light emitting position of the main light emitting unit 2*a*, the temperature sensor 12 is provided at the main light emitting position of the main light emitting unit 2*b*, and the temperature sensor 13 is provided at the main light emitting positions of the main light emitting units 2*d*, 2*d*'; however, no temperature sensors are provided for the main light emitting units 2*a*' through 2*c*'. As the temperature sensor, for example, a contact type thermistor or a non-contact type temperature sensor such as a thermopile may be used. Each main light emitting unit can be controlled to generate an arbitrary amount of heat, by separately setting a lighting rate for each main light emitting unit and energizing each main light emitting unit.

By using the heater main light emitting units (heat generating units) that are placed at different positions, it is possible to handle sheets of various sheet widths, while preventing the temperature from rising excessively at sheet non-passing parts on the fixing member, and suppressing wasteful power consumption. Furthermore, the number of temperature sensors, which are for monitoring the heat generated by the main light emitting units and implementing heater energizing control, can be made less than the number (division number) by which the heating member is divided into heater main light emitting units (heat generating units), and therefore costs can be reduced.

As illustrated in FIG. 2A, each heating member is configured to have light emitting units that do not overlap with each other, and the light emitting units are switched between a lit state and a non-lit state according to the sheet width of the passing sheet. For example, in a case of a sheet having a sheet width of less than or equal to L1, only the heating member 24 is energized. For all sheet widths, the heating member 24 is always energized and the main light emitting units 2*d*, 2*d*' are always lit. The heating members are controlled such that in the case of a sheet width of greater than L1 and less than or equal to L2, the heating members 23 and 24 are energized, in the case of a sheet width of greater than L2 and less than or equal to L3, the heating members 22 through 24 are energized, and in the case of a sheet width of greater than L3, the heating members 21 through 24 are energized.

In FIG. 2A, a temperature sensor is provided corresponding to each of the main light emitting units 2*a*, 2*b*, 2*d*, and 2*d*' of the heaters (heating members) 21 through 24. However, for main light emitting units 2*c*, 2*c*', no temperature sensors are provided for detecting the main light emitting units, and one temperature sensor 13 is used for detecting and controlling the temperature of the main light emitting units 2*c*, 2*c*', 2*d*, 2*d*'.

In the case of a central joining method, at the time of a print operation, a sheet is conveyed in a state of center matching, where the machine center and the center of the sheet width direction is always matching, with respect to the direction orthogonal to the conveying direction. Assuming that the sheet width slightly exceeds L1, heat of the parts corresponding to the light emitting areas of main light emitting units 2*d*, 2*d*' on the heating roller 14 is taken away by the sheet; however, as for the light emitting areas of the main light emitting units 2*c*, 2*c*', hardly any heat is taken away. As the position for providing the temperature sensor 13, which is for controlling the main light emitting units 2*c*, 2*c*' and the main light emitting units 2*d*, 2*d*', the light emitting area of the main light emitting units 2*d*, 2*d*' is selected, which is an area that is closer to the center.

Furthermore, in the present embodiment, a temperature sensor is not provided for the heating member 23. As to the main light emitting units 2*c*, 2*c*' of the heating member 23, the temperature sensor 13 provided for the main light emitting units 2*d*, 2*d*' adjacent to the main light emitting units 2*c*, 2*c*', and the temperature sensor 12 provided for the main light emitting unit 2*b*, are used for detecting the surface temperature of the corresponding positions. As an estimated value of the temperature corresponding to the main light emitting units 2*c*, 2*c*', for example, the average value of the temperature sensor 13 and the temperature sensor 12 may be used.

The temperature sensor 13 is for detecting both the temperature of the heat applied by the main light emitting units 2*d*, 2*d*' of the heating member 24 and the temperature of the heat applied by the main light emitting units 2*c*, 2*c*' of the adjacent heating member 23, and is therefore a common temperature sensor corresponding to a plurality of heat generating units.

Next, a description is given of a configuration of light emitting units (heat generating units) and temperature sensors of a side joining method according to a second embodiment of the present invention, with reference to FIG. 2B. In FIG. 2B, main light emitting units 2*e*, 2*f*, 2*g*, 2*h*, 2*i* are arranged inside the heating roller 14. The light emitting units are divided such that a main light emitting unit 2*e* and a main light emitting unit 2*f* are divided at a boundary line S4, a main light emitting unit 2*f* and a main light emitting unit 2*g* are divided at a boundary line S5, a main light emitting unit 2*g* and a main light emitting unit 2*h* are divided at a boundary line S6, and a main light emitting unit 2*h* and a main light emitting unit 2*i* are divided at a boundary line S7, and have light emitting areas at different positions so as not to overlap with each other in the sheet width direction.

Furthermore, on the surface of the heating roller 14, temperature sensors 31, 32, 33 for detecting the temperature on the roller are arranged. The temperature sensor 31 is provided at the main light emitting position of the main light emitting unit 2*e*, the temperature sensor 32 is provided at the main light emitting position of the main light emitting unit 2*g*, and the temperature sensor 33 is provided at the main light emitting position of the main light emitting unit 2*i*. As the temperature sensor, for example, a contact type thermistor or a non-contact type temperature sensor such as a thermopile may be used. Each main light emitting unit can be controlled to generate an arbitrary amount of heat by separately setting a lighting rate for each main light emitting unit and energizing each main light emitting unit.

By using the main light emitting units that are placed at different positions so as not to overlap with each other in the sheet width direction, it is possible to handle sheets of various sheet widths, while preventing the temperature from rising excessively at sheet non-passing parts on the fixing member, and suppressing wasteful power consumption. Furthermore, the number of temperature sensors, which are for monitoring the heat generated by the main light emitting units and implementing heater energizing control, can be made less than the number (division number) by which the heating member is divided into heater main light emitting units, and therefore costs can be reduced.

As illustrated in FIG. 2B, each heating member is configured to have light emitting units that do not overlap with each other, and the main light emitting units are switched between a lit state and a non-lit state according to the sheet width of the passing sheet. For example, in a case of a sheet having a sheet width of less than or equal to L1, only the main light emitting unit 2*e* is lit, and the main light emitting unit 2*e* is always lit for all sheet widths. The main light emitting units are controlled such that in the case of a sheet width of greater than L1 and less than or equal to L2, the main light emitting units 2*e* and 2*f* are lit, in the case of a sheet width of greater than L2 and less than or equal to L3, the main light emitting units 2*e*, 2*f*, 2*g*, 2*h* are lit, and in the case of a sheet width of greater than L3, the main light emitting units 2*e*, 2*f*, 2*g*, 2*h*, 2*i* are lit.

In FIG. 2B, a temperature sensor is provided corresponding to each of the main light emitting units 2*e*, 2*g*, 2*i* of the heaters (heating members) 25 through 29. However, for main light emitting units 2*f*, 2*h*, no temperature sensors are provided for detecting the main light emitting unit. The temperature sensors corresponding to adjacent main light emitting units are used for detecting and controlling the rise in the temperature of the main light emitting units 2*f*, 2*h*.

In the case of a side joining method, at the time of a print operation, a sheet is conveyed in a state where one side of the machine and one side of the sheet are always matching, with respect to the direction orthogonal to the sheet conveying direction. Assuming that the sheet width slightly exceeds L1, heat of the parts corresponding to the light emitting area of the main light emitting unit 2*e* on the heating roller 14 is taken away by the sheet; however, as for the light emitting area of the main light emitting unit 2*f*, hardly any heat is taken away. As the position for providing the temperature sensor 31, which is for controlling the main light emitting units 2*e*, 2*f*, the light emitting area of the main light emitting unit 2*e* is selected, which is an area that is on the sidemost part where the sheet always passes and light is emitted.

In the present embodiment, a temperature sensor is not provided for the heating members 26, 28. As to the main light emitting unit 2*f* of the heating member 26, the temperature sensor 31 provided for the heating member 25 and the temperature sensor 32 provided for the heating member 27, which are adjacent to the main light emitting unit 2*f*, are used for detecting the surface temperature of the corresponding position. As an estimated value of the temperature corresponding to the main light emitting unit for which a temperature sensor is not provided, for example, the average value of the two temperature sensors, which are adjacent to this main light emitting unit without a temperature sensor, may be used.

The temperature sensor 31 is for detecting both the temperature of the heat applied by the main light emitting unit 2*e* of the heating member 25 and the temperature of the heat applied by the main light emitting unit 2*f* of the adjacent heating member 26, and is therefore a common temperature sensor corresponding to a plurality of heat generating units.

Next, a description is given of temperature control. A description is given of the central joining method of FIG. 2A; however, this description is also applicable to the side joining method of FIG. 2B. The temperature detected by the common temperature sensor 13 (31) is output to the control unit, and the control unit controls the light emission of the main light emitting units 2*d*, 2*d*' (2*e*) of the heating member 24 (25) and the light emission of the main light emitting units 2*c*, 2*c*' (2*f*) of the heating member 23 (26).

The control by the control unit is done by setting a correction value for making the surface temperature of the heating roller 14 uniform, between the two heating members 23 (26), 24 (25), and controlling the main light emitting units 2*d*, 2*d*' (2*e*), 2*c*, 2*c*' (2*f*) based on this correction value. That is to say, there is no temperature sensor for directly detecting the temperature of the heat generated by the main light emitting units 2*c*, 2*c*' (2*f*), and therefore, the control unit uses the temperature detected by the common temperature sensor 13 (31) as a reference for controlling the lighting of the main light emitting units 2*c*, 2*c*' (2*f*).

Figure 3:
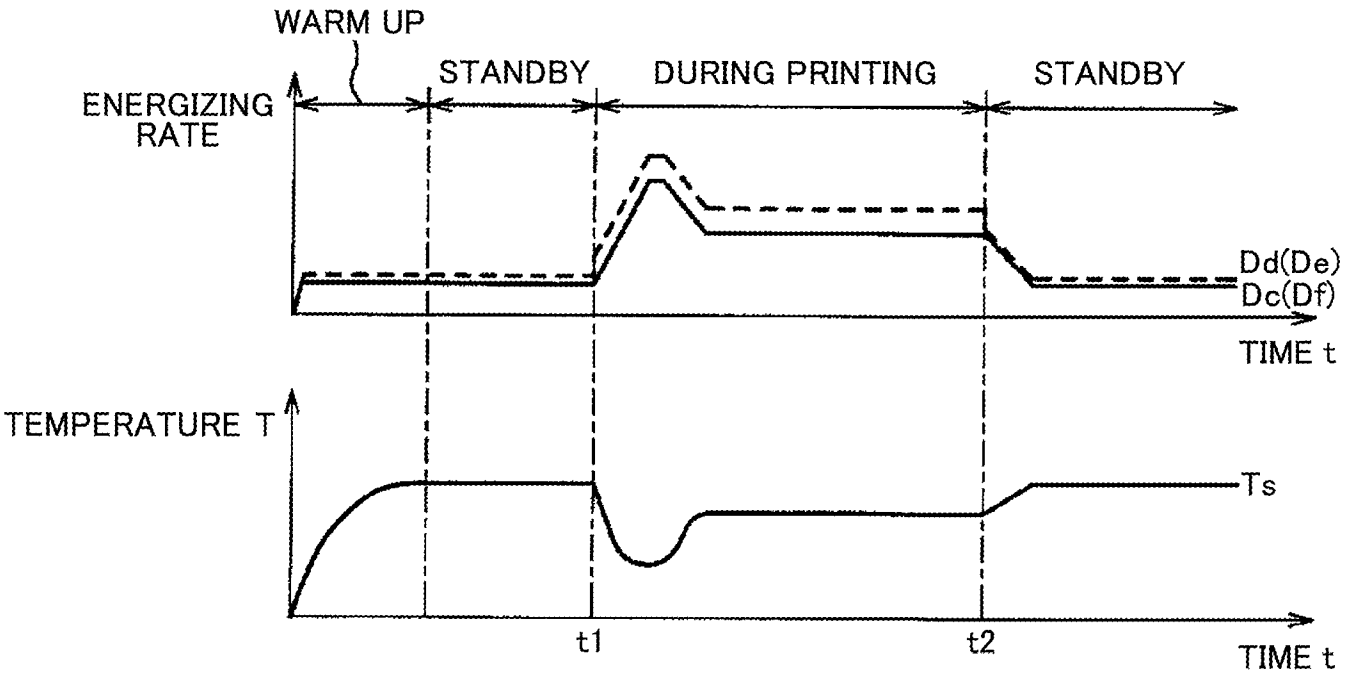
FIG. 3 is a timing chart illustrating control of heating members and the surface temperature of a fixing member according to an embodiment of the present invention.

FIG. 3 illustrates a state of lighting control when passing through a sheet having a sheet width of greater than L1 and less than or equal to L2. In this case, the heating members 23 (26) and 24 (25) are energized. In FIG. 3, Dc (Df) indicates the lighting rate of the heating member 23 (26), and Dd (De) indicates the lighting rate of the heating member 24 (25), and Ts indicates the temperature on the surface of the heating roller 14 detected by the temperature sensor 13 (31). The part between t1 and t2 corresponds to a printing operation in progress, and expresses how the lighting rates Dc (Df), Dd (De) are increased compared to that of a standby state in order to intensify the heating, for the purpose of addressing a drop in the temperature on the roller due to the passing sheets. In this case, the lighting rate Dd (De) of the heating member 24 (25) is calculated based on the value of Ts. As the calculation method, PID control is used, and control is implemented such that the temperature settles to near a target temperature of the light emitting area of the heating member 24 (25).

Meanwhile, Dc (Df) is calculated by a calculation formula Dc(Df)=Dd(De)*Dh1, where Dh1 is the lighting rate correction value. Similar to the heating member 24 (25), Dh1 is a value that is tuned in advance in consideration of the output of two heaters such that the roller surface temperature is made uniform to be near a certain target temperature in the light emitting area of the heating member 23 (26). For example, in the case of a heater configuration for generating the same heat amount when the heating members 23 (26), 24 (25) are controlled by the same lighting rate, the temperature on the surface of the roller can be made uniform by setting 1 as Dh1 (Dc(Df)=Dd(De)). As described above, as to the value of Dh1, for example, by making it possible to input variable values within the range of 0 through 2, even if the combination of heaters to be used changes, it is possible to create an ideal temperature distribution.

When the width of the sheet exceeds L2, in addition to the two heating members 23, 24 (25, 26) that are controlled by a single temperature sensor 13 (31), the heating members 21, 22 (27, 28) are also energized. The main light emitting units 2*a* through 2*d*' (2*e* through 2*i*) provided in the respective heating members have an effect of raising the temperature in areas other than the areas corresponding to these main light emitting units, due to heat transmission on the heating roller 14.

For example, when the sheet width is greater than L2 and less than or equal to L3, the heating members 22 through 24 (25 through 28) are energized, but heat is transmitted to the main light emitting areas of the main light emitting units 2*c*, 2*c*' (2*f*) due to the impact of heat generation by the main light emitting units 2*b*, 2*b*' (2*g*). Accordingly, the temperature on the heating roller corresponding to the light emitting parts of the main light emitting units 2*c*, 2*c*' (2*f*) without a temperature sensor for performing direct monitoring, becomes higher than anticipated. However, if tuning is performed on Dh1 in accordance with this case, in a mode where only the main light emitting units 2*c*, 2*c*', 2*d*, 2*d*' (2*e*, 2*f*) are lit, the temperature becomes insufficient and fixing failures may occur. Thus, in a case where the main light emitting units 2*b*, 2*b*', 2*c*, 2*c*', 2*d*, 2*d*' (2*e*, 2*f*, 2*g*) are lit, Dh2, which is different from Dh1, is used as the lighting rate correction value, and Dc (Df) is obtained by a formula Dc(Df)=Dd(De)*Dh2. Similarly, when the main light emitting units 2*a*, 2*a*', 2*b*, 2*b*', 2*c*, 2*c*', 2*d*, 2*d*' are lit, Dh3, which is a lighting rate correction value different from Dh1 and Dh2, is prepared, and Dc (Df) is obtained by Dc(Df)=Dd(De)*Dh3. Accordingly, even if the number of lit main light emitting units changes, it is possible to achieve a uniform temperature distribution in the longitudinal direction on the heating roller.

Next, there are cases where the temperature distribution in the sheet width direction does not become uniform, even in a mode where the same number of main light emitting units are lit. For example, In FIG. 4A, when the sheet width Ph1 is greater than L1 and less than or equal to L2, the main light emitting units 2*c*, 2*c*', 2*d*, 2*d*' are lit; however, there are sheets having a variety of widths within the range of L1 through L2, and therefore the temperature distribution does not become uniform by fixed heater control.

Figure 4A:
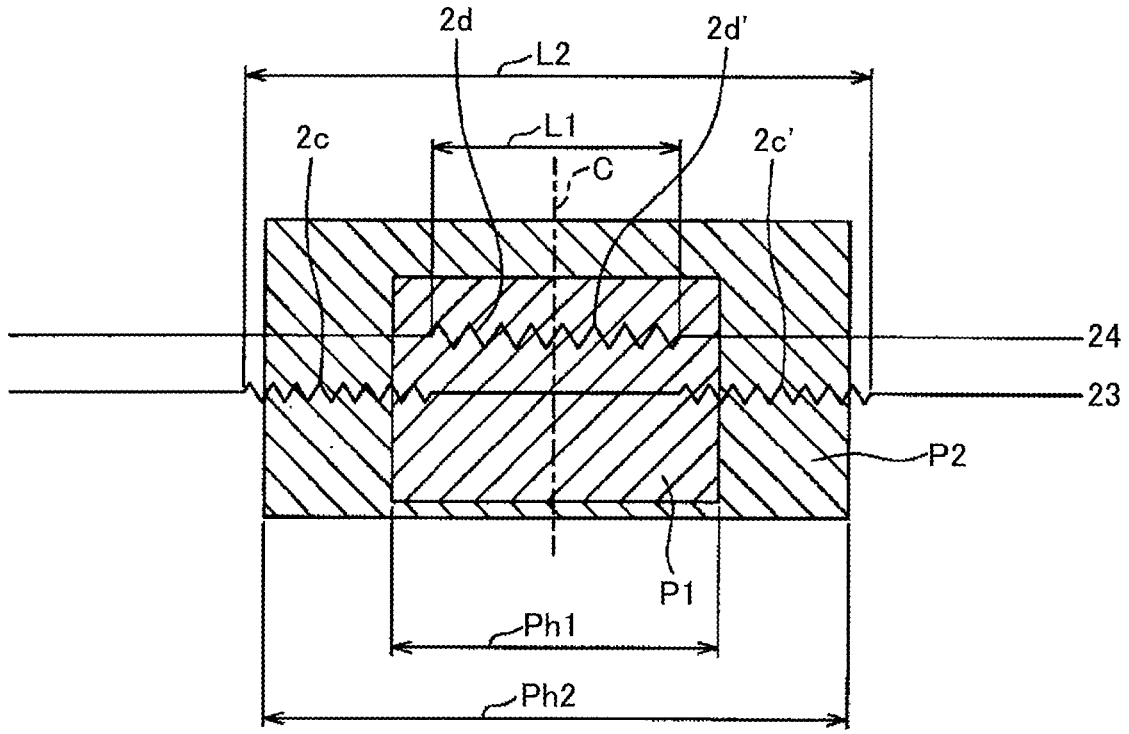
FIGS. 4A and 4B illustrate relationships between a center part of a heating member and recording sheets of two different widths, according to an embodiment of the present invention, where

In FIG. 4A illustrating a central joining method, P1 denotes a sheet having a width Ph1 and P2 denotes a sheet having a width Ph2, and the relationship Ph2>Ph1 is satisfied. Both P1 and P2 are sheets within the range of L1 through L2; however, these sheets have different widths, and therefore the excessive amounts of the light emitting parts of the main light emitting units 2*c*, 2*c*' are different for these sheets. In the case of the sheet P2, the sheet passes the position that is substantially the same as the outer edge of the light emitting part of the main light emitting unit 2*c*, and therefore there is hardly any loss in the heat of the light emitting part. On the other hand, in the case of the sheet P1, a large part of the light emitting part of the main light emitting units 2*c*, 2*c*' is excessive, and therefore the heat amount becomes excessive in the case of implementing heater energizing control assuming this sheet passes. Accordingly, the excessive heat is transmitted onto the heating roller, and consequently, even in the part where the sheet passes, the temperature becomes higher than the target value.

Therefore, correction is performed with a lighting rate corresponding to variations in the sheet width, to solve this problem. Specifically, the maximum width of a sheet that can be passed with main light emitting units 2*c*, 2*c*', is set to be L2 (this may be slightly less than or greater than the main light emitting length of the main light emitting units 2*c*, 2*c*'), and the lighting rate Dc of the main light emitting units 2*c*, 2*c*' is calculated by a formula Dc=Dd*Dh1*(Ph/L1). Ph is substituted with variables such as Ph1 and Ph2, which are the width of the sheet that is actually passed. Accordingly, even when a sheet having a small sheet width passes, it is possible to suppress any excessive heat generation by the main light emitting unit and to prevent the temperature balance from becoming non-uniform caused by the excessive heat.

Figure 4B:
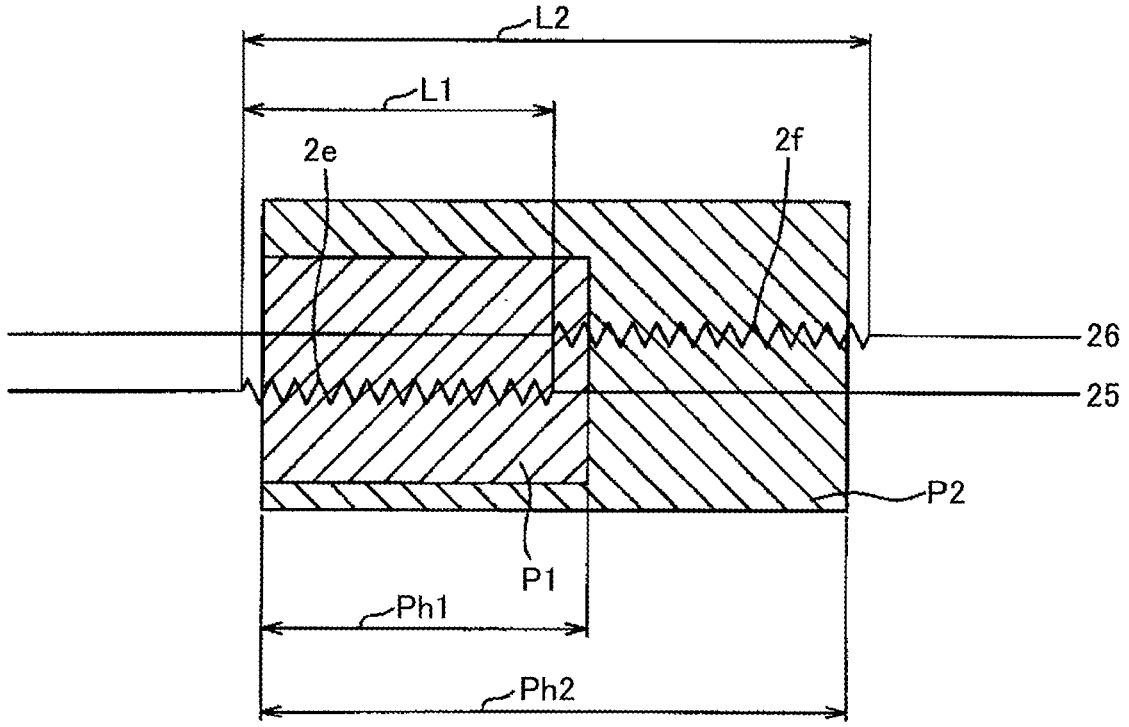

The same applies to the side joining method of FIG. 4B. In the side joining method of FIG. 4B, P1 denotes a sheet having a width Ph1 and P2 denotes a sheet having a width Ph2, and the relationship Ph2>Ph1 is satisfied. Both P1 and P2 are sheets within the range of L1 through L2; however, these sheets have different widths, and therefore the excessive amounts of the light emitting parts of the main light emitting unit 2*f* are different for these sheets. In the case of the sheet P2, the sheet passes the position that is substantially the same as the outer edge of the light emitting part of the main light emitting unit 2*f*, and therefore there is hardly any loss in the heat of the light emitting part. On the other hand, in the case of the sheet P1, a large part of the light emitting part of the main light emitting unit 2*f* is excessive, and therefore the heat amount becomes excessive in the case of implementing heater energizing control assuming this sheet passes. Accordingly, the excessive heat is transmitted onto the heating roller, and consequently, even in part where the sheet passes, the temperature becomes higher than the target value.

Therefore, correction is performed with a lighting rate corresponding to variations in the sheet width is performed, to solve this problem. Specifically, the maximum width of a sheet that can be passed with the main light emitting unit 2*f*, is set to be L2 (this may be slightly less than or greater than the main light emitting length of the main light emitting unit 2*f*), and the lighting rate Df of the main light emitting unit 2*f* is calculated by a formula Df=De*Dh1*(Ph/L1). Ph is substituted with variables such as Ph1 and Ph2, which are the width of the sheet that is actually passed. Accordingly, even when a sheet having a small sheet width passes, it is possible to suppress any excessive heat generation by the main light emitting unit and to prevent the temperature balance from becoming non-uniform caused by the excessive heat.

Next, a description is given of handling variations in the operation rate of the heating roller. Between the time before printing starts and the time immediately after printing starts, there is a large difference, in that heat is taken away by the sheet. Therefore, among the machine types that perform PID control, there are types where there is a delay in raising the lighting rate and the temperature drops significantly. In addition, in a system where the heat discharges into the air along the heating roller longitudinal direction, is higher at the end parts than at the center, the amount of temperature drop is different between the center part and the end parts. As printing continues, the heat accumulation increases in the fixing members, and it becomes possible to maintain the temperature near the target value by a lower lighting rate, and the difference in heat discharge between the center part and end parts is reduced. Therefore, the lighting rate correction between main light emitting units is changed from the initial period of printing and after time passes, thereby suppressing variations in the temperature due to the passage of time.

Figure 5:
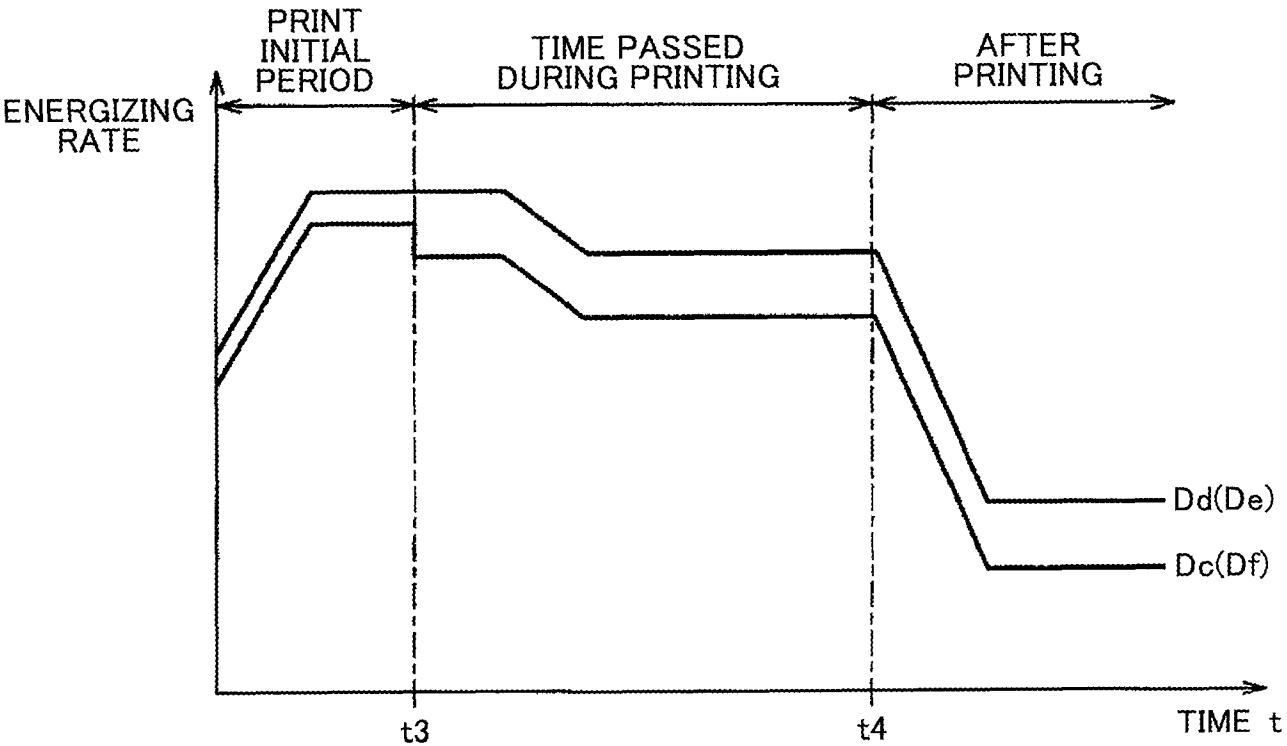
FIG. 5 is a timing chart illustrating control of heating members according to an embodiment of the present invention.

FIG. 5 illustrates the transition of the lighting rate in a case where control is implemented according to the operation status of the fixing device. In FIG. 5, the part before t3 indicates the initial period of the printing operation, t3 to t4 indicates a period when time has passed in the printing operation, and the part after t4 indicates a period after the printing operation. Here, the time from when printing starts until t3 is a variable value that can be arbitrarily specified. Furthermore, assuming that the main light emitting unit lighting rate correction value at the initial period of printing is Di, and the main light emitting unit lighting rate correction value in a period when time has passed in the printing operation is Dk, the lighting rate of the main light emitting units 2*c*, 2*c*' (2*f*) is calculated by Dc(Df)=Dd(De)*Dh1*Di in the case of the initial period of the printing operation, and calculated by Dc(Df)=Dd(De)*Dh1*Dk in a period when time has passed in the printing operation. In a configuration where the heat discharge at end parts is high, the values are set to satisfy Di>Dk such that the lighting rate is high in the initial period in consideration of heat discharge.

In the above, the heat control during printing is described; however, during the fixing operation, there is a warm-up state of heating the fixing unit to a fixing-possible temperature (temperature at which fixing is possible), and a standby state where it is possible to immediately respond to a print request while maintaining the temperature of the fixing unit that has been heated to the fixing-possible temperature. Sheets do not pass in either of these states, and the decrease in the heat amount is mainly caused by heat discharged into the air, and therefore a lighting rate correction value that is different from that during printing is necessary. Assuming that the lighting rate correction value during warm-up is Dhw, and the lighting rate correction value during standby is Dhs, the energizing control of the main light emitting units 2*c*, 2*c*' (2*f*) is implemented according to a formula Dc(Df)=Dd(De)*Dhw during warm-up and according to a formula Dc(Df)=Dd(De)*Dhs during standby. Thus, even in a state where the correction values differ by tuning, it is possible to control the temperature distribution on the heating roller to be in an arbitrary state.

Figure 6:
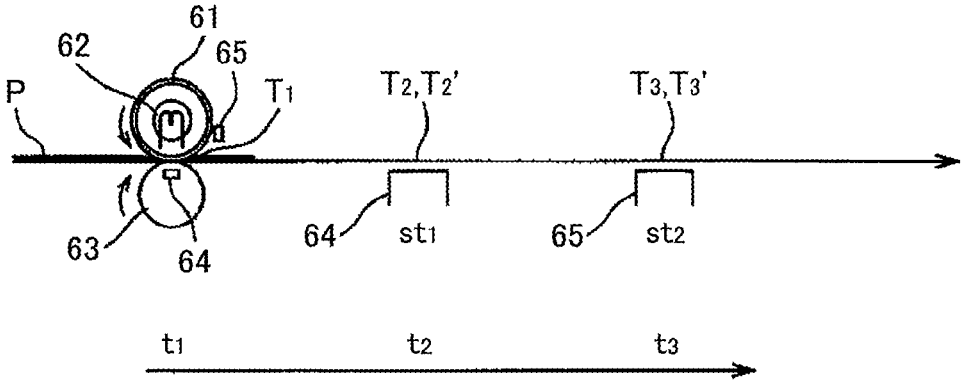
FIG. 6 illustrates the inside of a sheet quality sensor.

In addition to handling variations in the sizes of sheets, it is also necessary to handle variations in the thickness of sheets. A description is given of an operation of a sheet quality sensor for examining the temperature properties of a sheet. FIG. 6 illustrates a configuration for measuring temperature properties of a sheet, constituted by a heating roller 61 including a heating unit 62 inside for heating a sheet to a fixed temperature, and temperature sensors 64, 65 for examining how the sheet that has passed through the heating roller 61 is naturally cooling.

Figure 7:
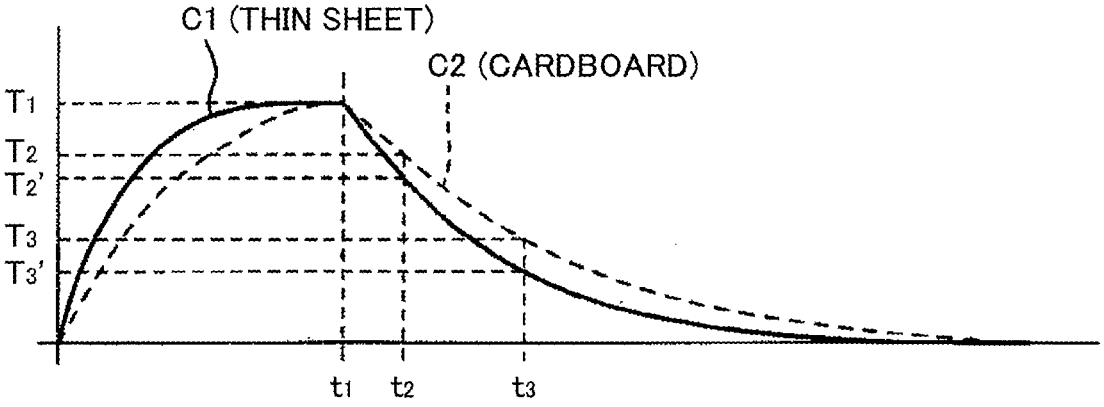
FIG. 7 illustrates the principle of measuring temperature properties of a recording sheet.

FIG. 7 illustrates the temperature rise and the cooling of a sheet. The sheets that pass through the heating roller 61 have different temperature rising properties according to their respective temperature properties. However, by adjusting the nip length and the sheet speed, the temperature of each sheet is raised to a predetermined temperature (T1) regardless of the temperature properties of the sheet. After the sheet passes through the heating roller 61, the temperature T2 of the sheet is measured at a time t2 with the sensor 64, and the temperature T3 of the sheet is measured at a time t3 with the sensor 65.

As to the thin sheet (C1) indicated by a solid line in FIG. 7, the temperature increases quickly and decreases quickly. Furthermore, as to the cardboard sheet (C2) indicated by a dashed line in FIG. 7, the temperature changes more gradually compared to that of the thin sheet (C1). By measuring the temperature properties of sheets, it is possible to implement the heating control by the fixing device in consideration of the sheet thickness. By recognizing how the temperature decreases per unit of time, it is possible to recognize the temperature properties of the sheet.

Furthermore, the temperature variations according to the passage of the sheet may be measured by providing the temperature sensor 64 inside the pressurizing roller at the part that contacts the heating roller, or providing the temperature sensor 65 near the heating roller at a part immediately after the sheet passes the heating roller. An example of the temperature variations measured by the temperature sensor 65 is the change during printing as illustrated in FIG. 3, where the surface temperature of the heating roller decreases due to the passing sheet.

By the configuration described above, a request of printing on sheets of various thicknesses and sizes while maintaining high productivity is accommodated by segmentalizing the light emitting length of the heater that is the heat source of the fixing device, so that it is possible to prevent wasteful energy from being generated and to prevent the temperature at the sheet non-passing part from rising excessively, and to prevent failures from occurring in the fixing device during the operation. Furthermore, the number of temperature sensors for monitoring the temperature can be made less than the number (division number) by which the heating member is divided into heater main light emitting units, and therefore costs can be reduced.

By providing light emitting units at different positions in a plurality of heat generating members, it is possible to flexibly handle various sheet widths of small sizes to large sizes.

If one temperature sensor is provided for each of the light emitting units, the cost increases according to the segmentation of the light emitting unit. In order to accommodate the recent circumstances where multiple-function and high-function are demanded while thorough cost reductions are also demanded, by using a single temperature sensor to monitor a heater having light emitting units that are adjacent to each other, it is possible to segmentalize the light emitting length while reducing cost.

Under the sheet condition of simultaneously using two heaters having adjacent light emitting units, by having a configuration of detecting the temperature of the light emitting units corresponding to the minimum sheet width through which the sheet always passes, it is possible to control the heater to address a temperature drop in a sheet passing part, so that abnormal images caused by fixing failures are prevented from being created.

As for two heating members for which the heater output relationship is known in advance, by preparing a lighting rate correction value in consideration of the difference in the output, it is possible to make the temperature rising tendency of the heater to which the correction control is applied, to be the same as the temperature rising tendency of the heater used as a reference. Therefore, it is possible to heat the fixing members in a uniform manner, even when a temperature sensor is not provided for each of the light emitting units. As the temperature distribution on the fixing member becomes uniform, it is possible to make the quality of the output object uniform. Furthermore, by making the correction value variable, it is possible to immediately respond as above, even when the heater configuration is changed.

In a main light emitting area of a heater, which is not directly monitored by a temperature sensor, the temperature rises when a heater having a main light emitting unit outside this area is lit. By setting the heater lighting rate correction value by taking this rise into consideration in advance, it is possible to achieve a uniform temperature distribution on the fixing member, similarly to a case of a mode where another heater is lit.

According to the number of heaters that are lit, even in a case where the lighting rate is corrected for a heater that is not directly monitored by a temperature, there may be cases where the temperature distribution on the fixing member becomes non-uniform due to the variation in the width of the passing sheets. In such a case, by incorporating information of the width of the passing sheet in the lighting rate correction, it is possible to maintain the temperature distribution on the fixing member in a target state, even if the sheet width changes.

In the initial period of the printing and in a period when time has passed in the printing operation, the heat accumulation state of the fixing member changes, and due to this change, the heat amount necessary for maintaining the target temperature changes. By having separate heater lighting rate correction values used for the initial period of the printing and for the period when time has passed in the printing operation, even when the above change occurs, it is possible to perform printing in a state where the target fixing temperature is maintained.

In different fixing statuses, i.e., in a printing status when sheets pass, and in a warming up status and a standby where sheets do not pass, the heat required for maintaining the temperature may change. By having different separate heater lighting rate correction values for the respective statuses, it is possible to control the surface of the fixing member by appropriate temperature conditions.

According to an embodiment of the present invention, the heat generating units of a plurality of heating members are provided inside a rotating member, for heating a sheet type recording medium. The heat generating units are provided at divisional positions in a direction orthogonal to the sheet type recording medium, which are positions that do not overlap with each other. Therefore, it is possible to implement control for driving only the heat generating units at positions necessary for heating. Accordingly, heat generating units are not driven at overlapping positions when heating is performed according to the width of the recording medium, and therefore the heating can be performed efficiently. Thus, there is no need to drive the heat generating units by a high heating rate, and therefore the temperature of the rotating member does not rise more than necessary. As a result, it is possible to prevent the rotating member from deforming due to a temperature rise.

Here, the above embodiment indicates a roller method, where the rotating member for conveying the sheet P and fixing a toner image on the sheet P is formed by the heating roller 14 and the pressurizing roller 15; however, the present invention is also applicable to a belt method. For example, although not illustrated, in the belt method, an endless fixing belt is wound between two heating rollers. A pressurizing roller is made to come in contact with the fixing belt, and a sheet P is conveyed between the fixing belt and the pressurizing roller.

In the heating roller in this belt method, the plurality of heating members of the embodiment described above are provided so that heat control is implemented by a control unit. This heat is transferred to the fixing belt to heat the fixing belt, so that the toner image on the sheet P is fixed. Accordingly, even in a fixing device of a belt method, heating can be performed efficiently, and there is no need to drive the heat generating units by a high heating rate, and therefore the temperature of the fixing belt does not rise more than necessary. As a result, it is possible to prevent failures such as deformation of the fixing belt caused by a temperature rise.

Furthermore, in the above embodiment, as the heat generating units of the heating members 21 through 24 (25 through 29) for heating the heating roller 14, the light emitting units 2*a* through 2*d'* (2*e* through 2*i*) are described as halogen heaters; however, the light generating units are not so limited, and nichrome wire heaters and sheathed heaters may be used.

Furthermore, in the above embodiment, there are four or five heating members and three temperature sensors corresponding to the heating members; however, the present invention is not so limited. For example, the numbers of heating members and temperature sensors may be appropriately increased or decreased according to the type of sheet size being used.

According to one embodiment of the present invention, the heat generating units in the plurality of heating members are provided so as not to overlap with each other in the direction of the sheet passing width orthogonal to the conveying direction of the sheet type recording medium, and therefore, it is possible to handle sheets of various sheet widths, while preventing the temperature from rising excessively at sheet non-passing parts on the fixing member (rotating member), and suppressing wasteful power consumption. Furthermore, the number of temperature sensors, which are for monitoring the heat generated by the heaters and implementing heater energizing control, can be made less than the number (division number) by which the heating member is divided into heater main light emitting units, and therefore costs can be reduced. Furthermore the heating members are controlled in accordance with the operational state of the fixing member that changes with time, and therefore power can be saved even when printing is not performed.

The fixing device and the image forming apparatus are not limited to the specific embodiments described herein, and variations and modifications may be made without departing from the spirit and scope of the present invention.

The present application is based on and claims the benefit of priority of Japanese Priority Patent Application No. 2013-052089, filed on Mar. 14, 2013, the entire contents of which are hereby incorporated herein by reference.

What is claimed is:

1. A fixing device corresponding to a plurality of sheet passing widths in a direction orthogonal to a conveying direction of a sheet type recording medium, the fixing device comprising:

a rotating member configured to convey the sheet type recording medium, rise in temperature, and fix toner;

a plurality of temperature sensors configured to detect a surface temperature on an outer side of the rotating member;

a plurality of heating members having a line shape, each heating member including at least one heat generating unit, the plurality of heating members being provided inside the rotating member in parallel with a rotation axis of the rotating member; and a control unit configured to control a heating state obtained by the plurality of heating members, wherein the heat generating units in the plurality of heating members are provided so as not to overlap with each other in the direction of the sheet passing width orthogonal to the conveying direction of the sheet type recording medium, the plurality of temperature sensors are placed at positions corresponding to the heat generating units used when printing on the sheet type recording medium having a minimum sheet passing width, and are not placed at positions corresponding to the heat generating units adjacent to the heat generating units used when printing on the sheet type recording medium having the minimum sheet passing width, and the control unit controls the heating state obtained by the plurality of heating members in accordance with the surface temperature, the sheet passing width, and an operational state of the rotating member that changes with time.

2. The fixing device according to claim 1, wherein the heat generating units of the plurality of heating members are controlled with a setting to have different rate relationships at a time when warming up from a stopped state of the fixing device, a time during printing, and a time of standby of waiting for a printing operation.

3. The fixing device according to claim 1, wherein in a continuous printing operation, the heat generating units of the plurality of heating members are controlled with a setting to have different rate relationships in an initial print period from when printing starts until a predetermined time, and in a steady period after the predetermined time has passed.

4. The fixing device according to claim 1, wherein the heat generating unit that does not have a corresponding temperature sensor is placed at a position adjacent to the heat generating unit at a center part of the rotating member, or at a position adjacent to the heat generating unit at a sidemost part of the rotating member.

5. The fixing device according to claim 1, wherein the heat generating unit that does not have a corresponding temperature sensor is controlled according to output of the temperature sensor corresponding to the heat generating unit adjacent to the heat generating unit that does not have a corresponding temperature sensor.

6. The fixing device according to claim 1, wherein the heat generating unit is controlled according to the sheet passing width and a thickness of the sheet type recording medium.

7. The fixing device according to claim 1, wherein in a case of printing for the sheet passing width by simultaneously using the heat generating unit at a center part of the rotating member and the heat generating unit adjacent to the heat generating unit at the center part of the rotating member, or by simultaneously using the heat generating unit at a sidemost part of the rotating member and the heat generating unit adjacent to the heat generating unit at the sidemost part of the rotating member, energizing lighting rates for the heat generating unit at the center part of the rotating member and the heat generating unit adjacent to the heat generating unit at the center part of the rotating member, or for the heat generating unit at the sidemost part of the rotating member and the heat generating unit adjacent to the heat generating unit at the sidemost part of the rotating member, are controlled to have a predetermined rate relationship, based on an output of the temperature sensor corresponding to the heat generating unit at the center part or the temperature sensor corresponding to the heat generating unit at the sidemost part.

8. The fixing device according to claim 7, wherein a ratio of energizing rates, for the heat generating unit at the center part of the rotating member and the heat generating unit adjacent to the heat generating unit at the center part of the rotating member, or for the heat generating unit at the sidemost part of the rotating member and the heat generating unit adjacent to the heat generating unit at the sidemost part of the rotating member, is changed, when the heat generating unit other than the heat generating unit at the center part of the rotating member and the heat generating unit adjacent to the heat generating unit at the center part of the rotating member, or other than the heat generating unit at the sidemost part of the rotating member and the heat generating unit adjacent to the heat generating unit at the sidemost part of the rotating member, is also energized.

9. The fixing device according to claim 7, wherein an energizing rate for the heat generating unit at the center part of the rotating member and the heat generating unit adjacent to the heat generating unit at the center part of the rotating member, or for the heat generating unit at the sidemost part of the rotating member and the heat generating unit adjacent to the heat generating unit at the sidemost part of the rotating member, is determined according to a ratio, the ratio being between a width of a sheet that is actually used for printing, and a total length of the heat generating unit at the center part of the rotating member and the heat generating unit adjacent to the heat generating unit at the center part of the rotating member, or a total length of the heat generating unit at the sidemost part of the rotating member and the heat generating unit adjacent to the heat generating unit at the sidemost part of the rotating member.

10. An image forming apparatus comprising:

the fixing device according to claim 1.

11. The fixing device according to claim 1, wherein the plurality of heating members are arranged in a parallel configuration.

12. The fixing device according to claim 1, wherein the plurality of heating members are at different planes.

* * * * *